US005628691A

United States Patent [19]

Shaner

[11] Patent Number: 5,628,691

[45] Date of Patent: May 13, 1997

[54] ADJUSTABLE LENGTH POOL CUE

[76] Inventor: David Shaner, 1540 Dylan Dr., Virginia Beach, Va. 23464

[21] Appl. No.: 513,218

[22] Filed: Aug. 10, 1995

[51] Int. Cl.[6] ..... A63D 15/08

[52] U.S. Cl. ..... 473/48

[58] Field of Search ..... 473/48, 296, 239; 278/58; 273/26 B, 67 A, 72 R; 135/15; 403/19

[56] References Cited

U.S. PATENT DOCUMENTS

| | | | |
|---|---|---|---|
| 2,991,096 | 7/1961 | Davidson | 278/58 |
| 3,259,407 | 7/1966 | Welt | 278/58 |
| 3,446,523 | 5/1969 | Little | 135/15 |
| 3,740,034 | 6/1973 | Scroggins | 473/48 |
| 3,833,012 | 9/1974 | McAllister | 473/296 |
| 4,238,164 | 12/1980 | Mazzolla | 403/109 |
| 4,653,142 | 3/1987 | Upton | 473/296 X |

*Primary Examiner*—Theatrice Brown
*Attorney, Agent, or Firm*—Galgano & Burke

[57] ABSTRACT

The present invention relates to an adjustable length pool cue for billiards, pool, snooker, and the like. The invention includes a cue rod having a butt end which is telescopically received within the open end of a tubular cue rod handle. A disc-shaped cam is eccentrically mounted on the butt end of the cue rod for rotatable movement between an unlocking position, wherein the cam is axially and peripherally aligned with the butt end of the cue rod to facilitate sliding telescopic movement of the cue rod within the cue rod handle, and a locking position, in which the cam is axially and peripherally offset relative to the butt end so as to frictionally grip and cammingly engage the cue rod handle, thereby locking the cue rod in a length-desired fixed position relative to the cue rod handle. The cue rod and cue rod handle are suitably configured and dimensioned such that axial rotation of the cue rod handle relative to the cue rod will effect movement of the cam into either the locking or unlocking position depending on the direction of axial rotation thereof.

4 Claims, 2 Drawing Sheets

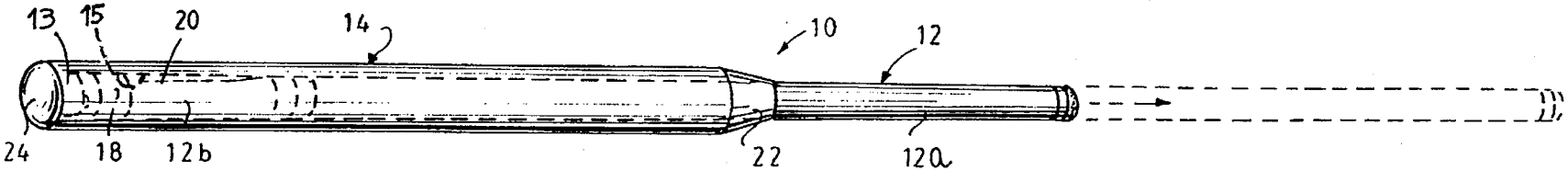
Fig. 1
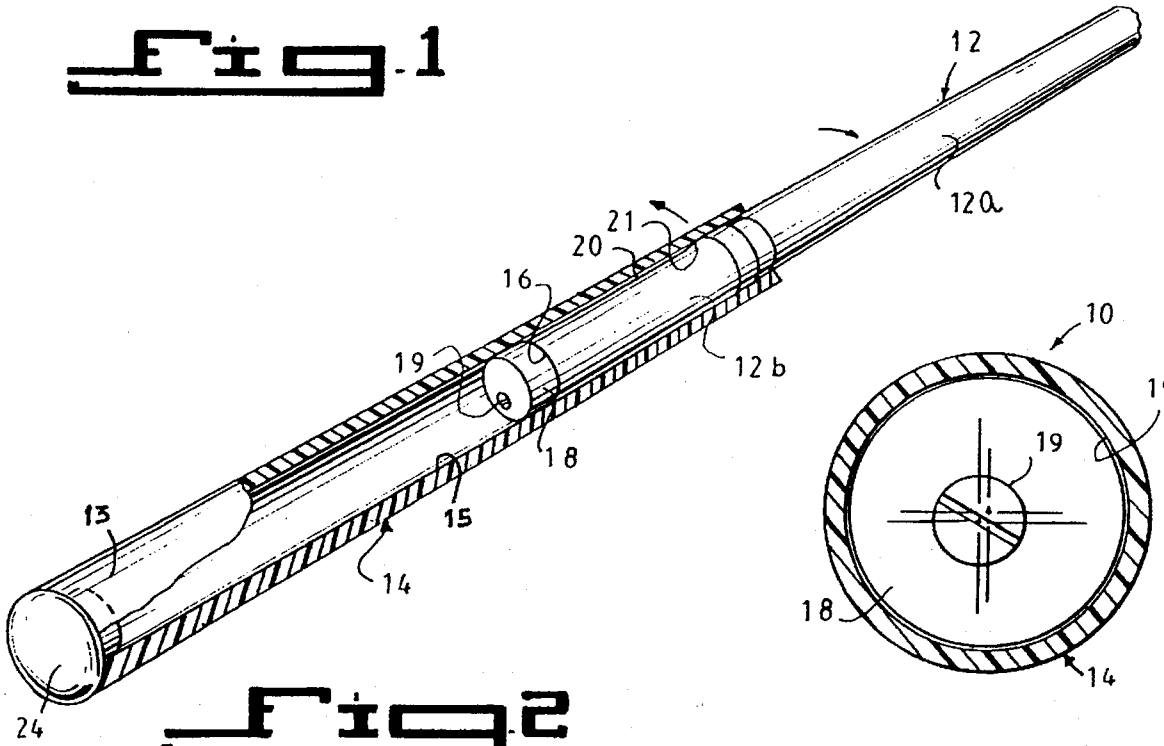
Fig. 2
Fig. 3
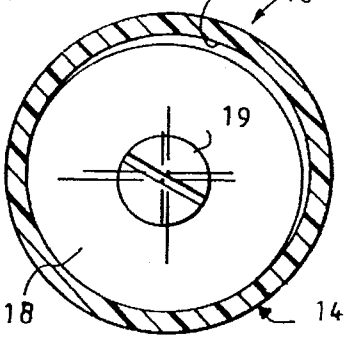
Fig. 4

ADJUSTABLE LENGTH POOL CUE

BACKGROUND OF THE INVENTION

1. Field of the Invention

The present invention relates to an adjustable length pool cue for billiards, pool, snooker and the like. More particularly, the present invention relates to a telescopically adjustable length pool cue having a rotatably mounted eccentric cam, whereby, the cam, when rotatably engaged, frictionally locks the two telescopic members in a length-desired position.

2. Description of the Prior Art

Numerous innovations for adjustable pool cues have been provided in the past. For example, Desmond et al., U.S. Pat. No. 4,718,671, discloses a telescopically adjustable game cue with a cylindrical collet disposed between two relatively moveable telescopic members which are urged towards one another when rotated relative to one another, thereby releasably locking the two telescopic members in desired position. In addition, Scroggins, U.S. Pat. No. 3,740,034 and Jolly, U.S. Pat. No. 4,949,964 also disclose pool cues whereby two telescopically received sections are releasably locked together. The Scroggins patent discloses a locking thimble sleeve located on the outer butt portion which, when tightened, locks the two sections together, while the Jolly patent discloses a cue whereby the members are threadably engaged and locked together. Keaggy, U.S. Pat. No. 5,267,730, discloses a game cue comprised of several threadably interchangeable parts for adjusting the length and weight of the cue for the various strokes played.

Other prior art patents disclose a variety of means for releasably locking two telescopic members together, although they do not deal specifically with pool cues (see, e.g., U.S. Pat. Nos. 2,873,129; 2,992,026; 3,098,669; 3,515,418; 3,814,023; and 5,011,319.) While apparently generally acceptable for their intended functions, by and large, the prior art locking devices are complicated in design, expensive and difficult to manufacture, and cumbersome to use. Moreover, as far as is known, none of the prior art devices afford an adjustable length pool cue for billiards, pool, snooker and the like as simple operation and construction as the present invent ion which affords the advantages hereinafter described.

SUMMARY OF THE INVENTION

Accordingly, it is an object of the present invention to provide a novel adjustable length pool cue which can be easily adjusted and releasably locked at various desired lengths positions for use in billiards, pool, snooker and the like.

It is another object of the present invention to provide an adjustable length pool cue which is economical to manufacture, durable and relatively of simple construction and design.

Another object of the invention is to provide an adjustable length pool cue which can be safely, sturdily and securely assembled.

Still another object of the present invention is to provide an adjustable length pool cue which is easily telescopically adjusted and releasably locked in a length-desired position.

Certain of the foregoing and related objects are attained in accordance with the present invention by the provision of an adjustable length pool cue, which includes a cue rod having a cue-tip end and a generally cylindrical butt end, and a tubular cue rod handle having an open end in which the butt end of the cue rod is slideably and telescopically receivable for adjusting the effective length of the pool cue. The pool cue further includes cam means for releasably locking the butt end of the cue rod in the cue rod handle in a friction-fit manner thereby fixing the effective length of the pool cue in the length-desired position. The cam means includes at least one disc-shaped cam eccentrically mounted on the butt end of the cue rod for rotatable movement between an unlocking position, in which the cam is axially and peripherally aligned with the butt end of the cue rod thereby facilitating sliding telescopic movement with the cue rod handle, and a locking position, in which the cam is axially and peripherally offset relative to the butt end of the cue rod so as to frictionally grip and cammingly engage the cue rod handle thereby locking the cue rod in a length-desired fixed position relative to the cue rod handle. The cam means, the cue rod and the cue rod handle are suitably configured and dimensioned such that axial rotation of the cue rod handle relative to the cue rod will effect movement of the cam means into either the locking or unlocking position depending on the direction of axial rotation.

In a particular preferred embodiment of the present invention, the cue rod has a circumferentially recessed portion extending from the butt end thereof. The recessed portion is positioned and dimensioned to axially and peripherally align with the cam when it is in its unlocked position, whereby the non-recessed portion of the cue rod will create a second area of frictional locking engagement between the cue rod handle and the cue rod when the cam is axially rotated and cammingly engaged in the locked position thereof.

In another particular preferred embodiment, a cue rod plug is mounted in the open end of the cue rod handle. The plug has a central bore suitably configured and dimensioned to slideably receive the cue rod. A generally cylindrical stopper is affixed to the butt end of the cue rod and is of greater dimension than the central bore of the plug so as to prevent the cue rod from complete detachment or removal from the cue rod handle.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements through the several views.

FIG. 1 is a perspective view of an adjustable length pool cue embodying the present invention showing the collapsed position thereof in solid line and the fully extended position thereof in phantom line;

FIG. 2 is a fragmentarily-illustrated, perspective view, in part section and with portions broken away, of the cue rod and cue rod handle;

FIG. 3 is a cross sectional view of the cue rod handle and the position of the eccentric cam in the axially and peripherally aligned unlocked position thereof;

FIG. 4 is a cross sectional view similar to that of FIG. 3, but showing the eccentric cam in an offset locking position thereof;

DETAILED DESCRIPTION OF THE PREFERRED EMBODIMENT

Figure 5:
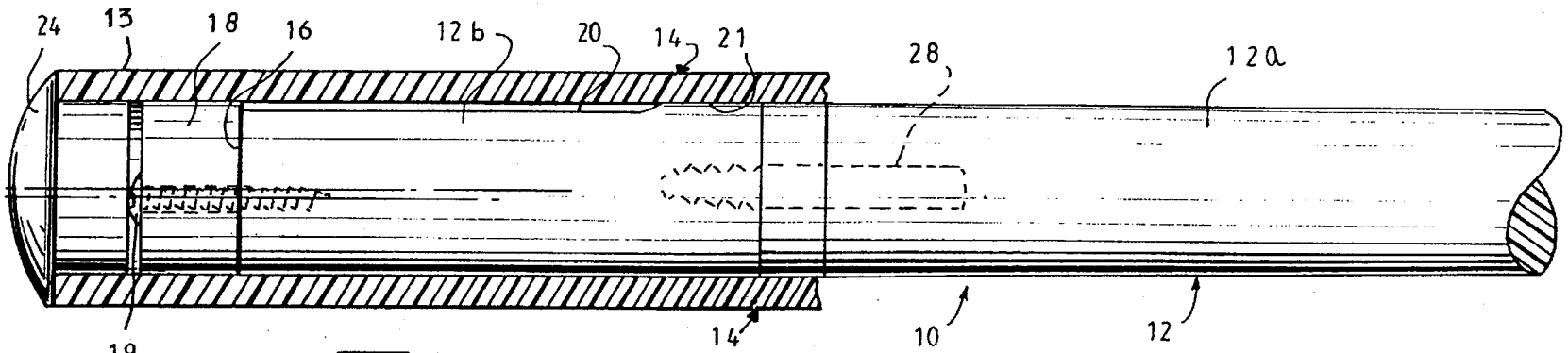
FIG. 5 is an enlarged fragmentarily-illustrated side elevational view, in part section, of the cue rod and handle with the cam in the locking position thereof.

Turning now in detail to the appended drawings, and in particular FIG. 1 thereof, therein illustrated is a novel adjustable length pool cue or cue stick, embodying the present invention, generally designated by reference numeral 10. Pool cue 10 includes a generally cylindrical cue rod 12 telescopically received within a generally cylindrical cue rod handle 14 both of which are configured and dimensioned to facilitate easy slidable telescopic movement between cue rod 12 and cue rod handle 14. A resilient, tapered frustoconical sleeve 22, usually made of rubber, is preferably attached to the inner end of the cue rod handle 14 to provide a smooth transition from the handle 14 to rod 12.

As seen in FIGS. 2–4, a freely rotatable eccentric cog or cam 18 is mounted upon the butt end 16 of the cue rod 12 via a screw or pin 19 such that, when it is in a neutral or unlocked position (FIG. 3), cam 18 is axially and peripherally aligned with butt end 16 of cue rod 12 allowing easy telescopic movement of the cue rod 12 within the cue rod handle 14. When relative counter-rotative movement is applied, between cue rod 12 and handle 14 (approximately ⅛th of a turn as indicated by the arrows in FIG. 2), cam 18 will pivot to an axially offset or mis-aligned position with respect to the butt end 16 and frictionally abut against the inside wall 15 of the cue rod handle 14 (FIG. 4). This locks the pool cue 10 via a camming action in a length-desired position relating to handle 14.

As shown in FIG. 5, the pool cue 12 may be composed of two or more sections **12*a*, 12*b* secured together via hex bolt 28 as a means for thereby allowing easy assembly and disassembly thereof. In addition, a mushroom-shaped protective rubber cap or bumper 24 is preferably affixed to butt end 13 of cue rod handle 14** in a friction-fit or snap-fit manner.

As seen best in FIG. 5, cue rod section **12*b* adjacent butt end 16 is preferably provided with peripherally recessed section 20 which, when cam 18 is rotatably engaged to assume its locking position (as illustrated in FIG. 4), creates a second area of frictional engagement along a non-recessed. section 21 thereof located between the cue rod section 12*a* and the recessed section 20, providing additional locking or camming power for holding the pool cue 10 in a fixed position relative to cue rod handle 14**. This peripheral relief affords better alignment of the cue rod and handle. This is important since any warp in a cue stick adds undesirable or unintentional "English" to the cue ball.

Figure 6:
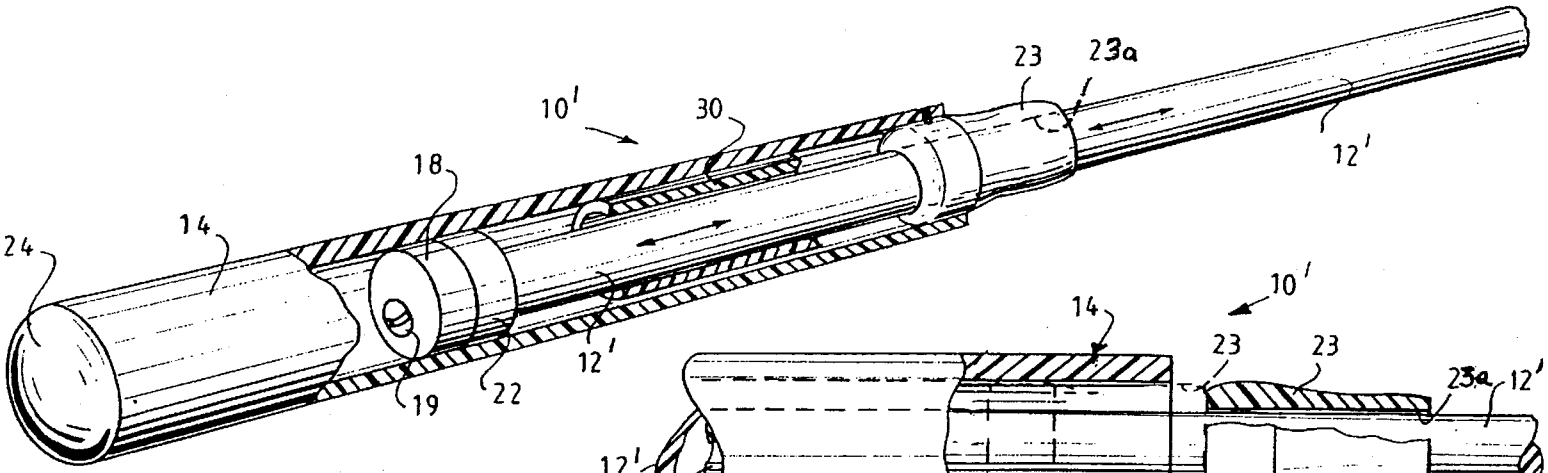
FIG. 6 is a fragmentarily-illustrated perspective view, in part section and with portions broken away of another embodiment of the present invention.
Figure 7:
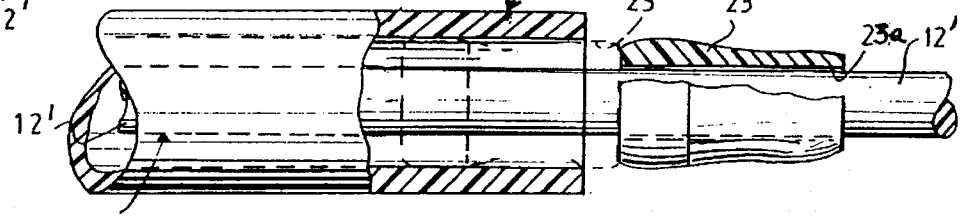
FIG. 7 is a fragmentarily-illustrated, partly exploded, side elevational view, in part section and with portions broken away, off the embodiment shown in FIG. 6, showing, in phantom line, the full extension of the cue rod from the cue rod handle and the mounted position of the plug.

FIGS. 6 and 7 illustrates another embodiment of the present invention for a pool cue 10' intended for commercial pool hall establishments. The pool cue rod 12' is not tapered but instead has a reduced or narrow cylindrical cross section. An enlarged stopper 22 is affixed to the butt end of the cue rod 12'. As seen most clearly in FIG. 6, the eccentric cam 18 is mounted upon the stopper 22 by screw 19 in a similar fashion to the embodiment of FIGS. 1–5. A plug 23 having a central bore **23*a* through which the cue rod 12' passes is permanently affixed on the open end of cue rod handle 14**.

As seen best in FIG. 7, plug 23 (shown in phantom line in its mounted position and in full line prior to mounting) serves to prevent the stopper 22 and, in turn, the cue rod 12' from being removed from the cue rod handle 14. Telescopic movement between the cue rod 12' and the cue rod handle 14 is restricted to within the cue rod handle 14 only and, once assembled, separation of the pool cue 10' is difficult; this being desirable in a commercial pool hall setting.

As also shown in FIG. 6, the commercial establishment embodiment may also be provided with a loose sleeve 30 fitted on the cue rod 12' between the stopper 22 and plug 23 to further restrict extension of the cue rod 12' from handle 14.

Either model allows the user to adjust the length of the pool cue to accommodate tight places where a full length cue stick cannot be used. In this way, the user can use the same cue for all shots with the same weight cue instead of changing to various length and weighted cue sticks which is the practice today.

In a particular preferred embodiment of the invention, the cue rod handle consists of a rubber-coated or covered thin wall aluminum, fiberglass and/or plastic tubing measuring 25½ inches in overall length and having an inside diameter of 0.925 inches. The eccentric cam and butt end of the cue rod preferably has an outside diameter of 59/64ths inches and the cue rod tip and has an outside diameter of 7/16ths inches. The overall length of the cue rod is preferably 38 inches so as to provide a pool cue adjustable between a contracted or retracted length of 40" to a fully extended state of approximately 60 inches. Of course, these dimensions may be varied to suit the particular application.

Various modifications may be made as will be apparent to those skilled in the art. For example, while the cue rod 12 is preferably telescopically received within the cue rod handle 14, an alternative embodiment could possibly have the telescopic members reversed and the cam 18 mounted on the cue rod handle 14. While generally acceptable in its preferred cylindrical or tapered shape, other alternative embodiments of the pool cue 10 would be variously shaped and sized. While the pool cue 10 is preferably made off wood or plastic, it could be manufactured from aluminum, fiberglass, graphite, and/or combinations thereof.

Accordingly, while only several preferred embodiments of the present invention have been illustrated in the appended drawings, it is to be understood that various modifications may be made as will be apparent to those skilled in the art.

What is claimed is:

1. An adjustable length pool cue for use in playing billiards, pool, and snooker, said adjustable length pool cue comprising:

a cue rod having a cue-tip end and a generally cylindrical butt end;

a generally tubular cue rod handle having an open end in which said butt end of said cue rod is slideably and telescopically received for adjusting the effective length of said pool cue; and cam means for releasably locking said butt end of said cue rod in said cue rod handle in a friction-fit manner to fix the effective length of said pool cue, said cam means including a generally circular disc-shaped cam eccentrically mounted on said butt end of said cue rod for rotatable movement between an unlocking position, in which said cam is axially and peripherally aligned with said butt end of said cue rod to facilitate sliding telescopic movement thereof within said cue rod handle, and a locking position, in which said cam is axially and peripherally offset relative to said butt end of said cue rod so as to frictionally grip and cammingly engage said cue rod handle thereby locking said cue rod in a length-desired fixed position relative to said cue rod handle, said cam means, said cue rod and said cue rod handle being suitably configured and dimensioned such that axial rotation of said cue rod handle relative to said cue rod will effect movement of said cam means into either said locking or unlocking position thereof, depending on the direction of axial rotation, and wherein said cue rod has a circumferentially recessed portion extending from said butt end which is positioned and dimensioned to axially and peripherally align with said cam when in said unlocked position thereof, whereby the non-recessed portion of said cue rod will create a second area of frictional locking engagement between said cue rod handle and said cue rod when said cam is axially rotated and cammingly engaged in said locked position.

2. An adjustable length pool cue for use in playing billiard, pool, and snooker, said adjustable length pool cue, comprising:

a cue rod having a cue-tip end and a generally cylindrical butt end;

a generally tubular cue rod handle having an open end in which said butt end of said cue rod is slideably and telescopically received for adjusting the effective length of said pool cue;

cam means for releasably locking said butt end of said cue rod in said cue rod handle in a friction-fit manner to fix the effective length of said pool cue, said cam means including a generally circular disc-shaped cam eccentrically mounted on said butt end of said cue rod for rotatable movement between an unlocking position, in which said cam is axially and peripherally aligned with said butt end of said cue rod to facilitate sliding telescopic movement thereof within said cue rod handle, and a locking position, in which said cam is axially and peripherally offset relative to said butt end of said cue rod so as to frictionally grip and cammingly engage said cue rod handle thereby locking said cue rod in a length-desired fixed position relative to said cue rod handle, said cam means, said cue rod and said cue rod handle being suitably configured and dimensioned such that axial rotation of said cue rod handle relative to said cue rod will effect movement of said cam means into either said locking or unlocking position thereof, depending on the direction of axial rotation; and a cue rod plug mounted in said open end of said cue rod handle, said plug having a central bore suitably configured and dimensioned to slideably receive said cue rod, and wherein said butt end of said cue rod has a generally cylindrical stopper affixed thereto which is of greater dimension than said central bore of said plug so as to prevent said cue rod from complete removal from said cue rod handle.

3. The adjustable length pool cue of claim 1, wherein said handle has a closed end opposite to said open end thereof.

4. The adjustable length pool cue of claim 2, wherein said handle has a closed end opposite to said open end thereof.

* * * * *